US006374914B1

(12) United States Patent
Wong et al.

(10) Patent No.: US 6,374,914 B1
(45) Date of Patent: Apr. 23, 2002

(54) DUEL COMPLETION BOP CENTRALIZER

(75) Inventors: Henry Wong, Houston; Gregory L. Glidden; Richard T. Schmidt, both of Spring, all of TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/572,829

(22) Filed: May 17, 2000

(51) Int. Cl.[7] ..... F21B 17/10

(52) U.S. Cl. ..... 166/241.1; 166/85.5

(58) Field of Search ..... 166/85.3, 85.4, 166/85.5, 241.1, 241.6, 241.5, 241.7, 382, 313

(56) References Cited

U.S. PATENT DOCUMENTS

| | | | | |
|---|---|---|---|---|
| 3,108,639 A | * | 10/1963 | Brooks | 166/241.7 |
| 4,930,573 A | * | 6/1990 | Lane et al. | 166/120 |
| 5,730,218 A | | 3/1998 | Swagerty et al. | |
| 5,775,420 A | * | 7/1998 | Mitchell et al. | 166/85.4 |
| 5,896,925 A | | 4/1999 | Swagerty et al. | |

FOREIGN PATENT DOCUMENTS

| | | | |
|---|---|---|---|
| GB | 2257447 | * | 1/1993 |

* cited by examiner

*Primary Examiner*—David Bagnell
*Assistant Examiner*—Jennifer R. Dougherty
(74) *Attorney, Agent, or Firm*—Henry C. Query, Jr.

(57) ABSTRACT

A centralizer for guiding a well servicing tool through the bore of a BOP stack or the like and into a radially eccentric position within a wellhead assembly, the centralizer comprising a mandrel having a top end which is connected to a running string and a bottom end to which the well servicing tool is connected, a collar having at least one eccentric hole through which the mandrel extends, the collar being rotatably connected to the mandrel, and an energy absorbing bumper supported above the collar and having at least one opening in alignment with the hole in the collar through which the top end of the mandrel projects; wherein the distance between the center of the collar and the center of the eccentric hole is selected to correspond to the radial distance between the center of the BOP bore and the eccentric position within the wellhead assembly; and wherein the outer diameters of both the collar and the bumper are selected to be only slightly smaller than the diameter of the BOP bore; such that the collar and the bumper will maintain the mandrel, and thus the tool, in alignment with the eccentric position as the tool is being run into the wellhead.

15 Claims, 5 Drawing Sheets

DUEL COMPLETION BOP CENTRALIZER

BACKGROUND OF THE INVENTION

This invention relates to a centralizer for a down hole tool for oil and gas well completion and servicing operations. More particularly, the invention relates to such a centralizer which is especially adapted for use in dual well completion applications.

During oil and gas well completion and servicing operations, the need often arises to run a well servicing tool from the rig down to a piece of equipment located in the wellhead assembly, for example, to install a back pressure valve ("BPV") in the production bore or receptacle of a tubing hanger mounted in the wellhead. This is usually accomplished by attaching the tool to a running string, such as a sucker rod or drill string. In typical oil and gas wells, the wellhead may be located a substantial distance below the rig floor. In addition, a blow out preventer ("BOP") stack is usually connected to the wellhead during completion and servicing operations to contain any inadvertent well blow-outs that may occur. In offshore wells, the wellhead is connected to the rig by a riser pipe. Thus, during completion and servicing operations the servicing tool must be run down through the riser and the internal bore of the BOP stack, and the possibility exists that the tool may impact the riser or the BOP stack, causing damage to the BOP stack or the tool itself. Furthermore, if a blow out occurs while the tool is positioned in the wellhead, the tool may be propelled back into the BOP stack and damage the BOP rams.

The prior art has addressed this problem by providing a tool protection guide between the running string and the well servicing tool to center the tool within the riser and the BOP bore as the tool is being run into the wellhead. As disclosed more fully in U.S. Pat. No. 5,730,218, which is owned by the assignee hereof, this prior art tool protection guide comprises an elongated mandrel having a top end which is connected to the running string and a bottom end to which the tool is connected, a circular top collar having a concentric hole through which the mandrel extends, means for rotatably connecting the top collar to the mandrel, a circular bottom collar which is connected to the top collar by a number of bow springs which together form a centralizing shroud for the tool, and an energy absorbing bumper positioned above the top collar and having an opening in alignment with the hole in the top collar through which the top end of the mandrel projects. Thus, the centralizing shroud keeps the tool centered within the riser and the bore of the BOP stack as it is being run down to the wellhead to prevent the tool from impacting the riser or the BOP stack, and the energy absorbing bumper absorbs the impact on the BOP rams should the tool be propelled into the BOP stack during a well blow out. However, since the mandrel is centered within the centralizing shroud, this tool protection guide is not useful for running tools into dual completion wellheads, which typically comprise a dual tubing hanger having two production bores or receptacles which are offset from center. Thus, a need exists for a guide or centralizer which can align the well servicing tool with the offset bores of a dual completion wellhead.

SUMMARY OF THE INVENTION

The present invention addresses this and other problems by providing a centralizer for guiding a well servicing tool through the bore of a BOP stack or the like and into a radially eccentric position within a wellhead assembly, the centralizer comprising a mandrel having a top end which is connected to a running string and a bottom end to which the well servicing tool is connected, a collar having at least one eccentric hole through which the mandrel extends, means for rotatably connecting the collar to the mandrel, and an energy absorbing bumper supported above the collar and having at least one opening in alignment with the hole in the collar through which the top end of the mandrel projects. The distance between the center of the collar and the center of the eccentric hole is selected to correspond to the radial distance between the center of the BOP bore and the eccentric position within the wellhead assembly. In addition, in the preferred embodiment of the invention the outer diameters of both the collar and the bumper are selected to be only slightly smaller than the diameter of the BOP bore so that the collar and the bumper will maintain the mandrel, and thus the tool, in alignment with this eccentric position as the tool is being run into the wellhead. Furthermore, since the mandrel is rotatable with respect to the collar and the bumper, the centralizer may be used to run tools which require either linear or rotary action to be set in the wellhead component.

In an exemplary embodiment of the invention, the well servicing tool is a BPV and the eccentric position in the wellhead assembly corresponds to one of the production bores or receptacles of a dual tubing hanger in a dual completion wellhead. As the BPV is being run through the BOP stack, the collar and the bumper will maintain the BPV in alignment with the receptacle in the tubing hanger and prevent the BPV from contacting the BOP bore. In addition, if a blow out should occur and the BPV and running string are propelled back into the BOP stack, the energy absorbing bumper will absorb the energy of the impact between the BPV and the BOP rams and thereby prevent or minimize damage to the BOP rams.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
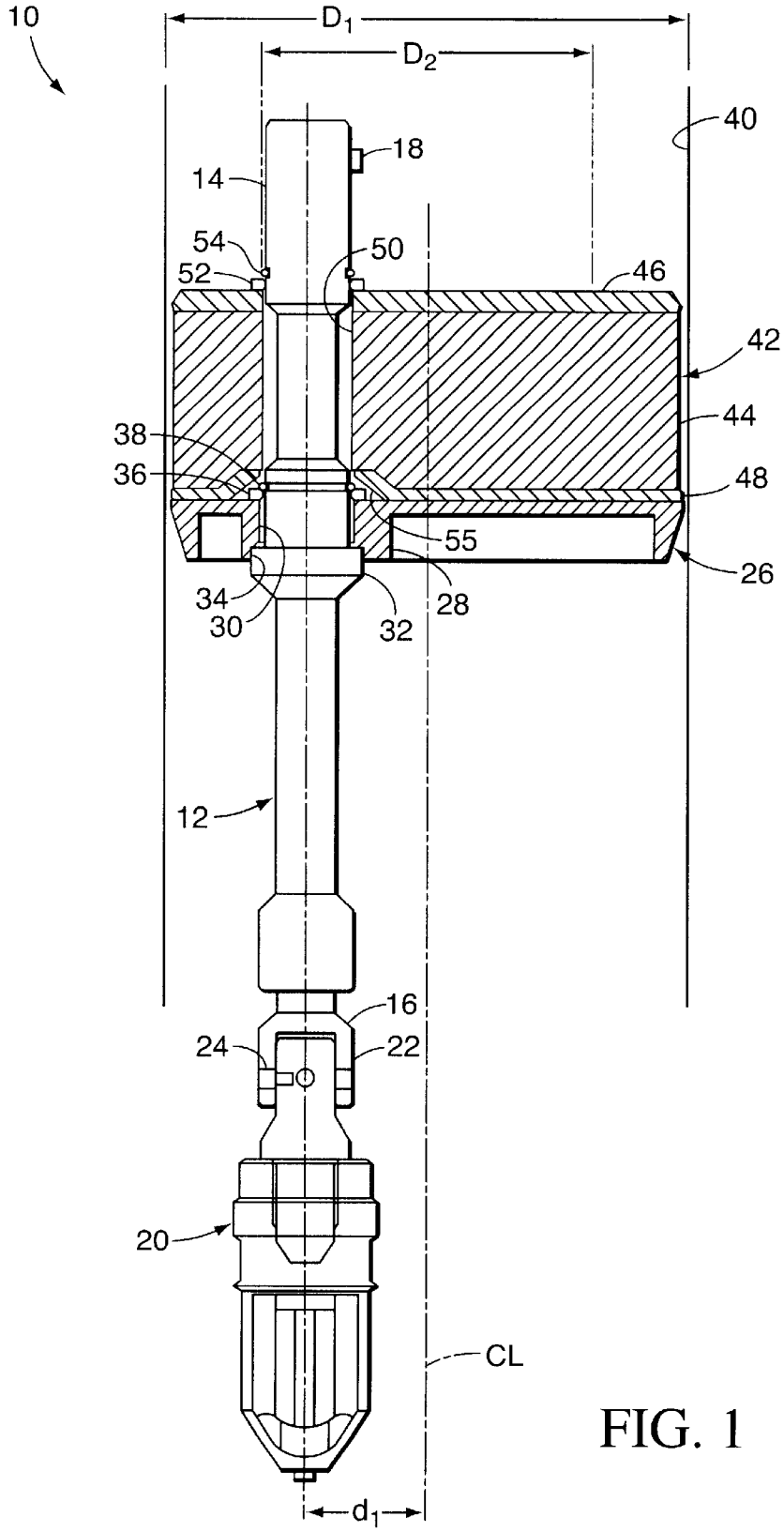
FIG. 1 is a front sectional view of the centralizer of the present invention.

Referring to FIG. 1, the centralizer of the present invention, which is indicated generally by reference number 10, is shown to comprise an elongated mandrel 12 having a top end or stem 14 and a bottom end 16. The top end 14 is connected to a running string (not shown) by any suitable means, such as bolts, threads or, as illustrated in FIG. 1, a pin 18. The top end may also be configured to receive various connection adapters to facilitate connecting mandrel 12 to various running strings with known attachment means. The bottom end 16 includes conventional means for connecting a well servicing tool 20 to the mandrel 12. For example, in the embodiment of the centralizer 10 depicted in FIG. 1, the bottom end 16 comprises a receptacle 22 into which a mating portion of the well servicing tool 20 is inserted, and a shear pin 24 which is inserted through corresponding holes in the receptacle 22 and the mating portion of the well servicing tool 20 to secure the well servicing tool 20 within the receptacle 22.

While the centralizer 10 may be used with any of a variety of well servicing tools and the like, the well servicing tool 20 illustrated in the figures and discussed herein is a BPV, such as the FMC Type ISA-100 BPV or the Cameron Iron Works Type "H" BPV. Such BPV's are designed to be installed within the production bore or receptacle of a tubing hanger. Of particular relevance to the present invention, the need often arises during well completion or servicing operations to install such BPV's in one or both receptacles of a dual tubing hanger, which comprises two receptacles offset from the center of the wellhead bore. The centralizer 10 of the present invention is particularly useful for such applications.

Referring still to FIG. 1, the centralizer 10 preferably also includes a generally circular collar 26 which comprises at least one offset hub 28 having a hole 30 through which the mandrel 12 extends. Collar 26 is supported on a flange 32 extending radially outwardly from the mandrel 12 between the top end 14 and the bottom end 16 thereof. In the preferred embodiment of the invention, flange 32 is at least partially received within a counterbore 34 formed in the bottom of hub 28 coaxial with hole 30, and the diameter of flange 32 is approximately the same as the diameter of counterbore 34 so as to restrict relative radial movement between collar 26 and mandrel 12. The collar 26 is restrained from moving axially relative to mandrel 12 by the flange 32 on one side and a washer 36 on the other, which itself is restrained by a garter spring 38 received in a corresponding groove formed in the mandrel 12. Thus, the mandrel 12 is permitted to rotate relative to the collar 26 to facilitate use of the centralizer 10 with well servicing tools that require rotary action to be set in a wellhead component.

The outer diameter of collar 26 is selected to be only slightly smaller than the diameter "$D_1$" of the BOP bore 40 and is also preferably beveled from top to bottom to facilitate the passage of the centralizer 10 through the BOP bore. The distance "$d_1$" between the centerline "CL" of the collar 26 and the center of hole 30 is selected to correspond to the radial distance between the center of the BOP bore 40 and a radially eccentric position within the wellhead bore (not shown), such as the center of a receptacle in a dual tubing hanger. In this manner, the collar 26 will maintain the mandrel 12, and thus the BPV 20, in alignment with the receptacle as the tool is being lowered through the BOP bore 40 and into the wellhead and prevent the BPV 20 from impacting the BOP bore 40.

According to the preferred embodiment of the invention, the centralizer 10 also comprises an energy absorbing bumper 42, which is designed to absorb the energy of impact between the centralizer 10 and, for example, the rams of the BOP (not shown) in the event of a well blow out or pressure surge by deforming or collapsing at a predetermined vertical load. In the exemplary embodiment of the invention depicted in the drawings, the bumper 42 comprises an energy absorbing core 44 sandwiched between a top plate 46 and a bottom plate 48. As discussed more fully in U.S. Pat. No. 5,730,218, which is incorporated herein by reference, the core 44 is constructed of a lightweight material having a uniformly distributed strength and the ability to collapse under a predetermined force yet still maintain load bearing properties. One preferred material is a thin aluminum or metal foil formed with an internal honeycomb structure and having a thin outer coating or foil to prevent foreign substances from entering the core 44 and affecting its strength properties. The honeycomb structure preferably comprises a plurality of hollow hexagonal columns in axial cross section. It should be understood, however, that any other suitable material, such as high density foam, could be used to construct core 44. The top and bottom plates are preferably constructed of a strong metallic material, such as steel, and are joined to the core 44 by any suitable means, such as an adhesive.

The bumper 42 also comprises an opening 50 extending through the core 44 and the top and bottom plates 46, 48 in alignment with the hole 30 in the collar 26 to allow the top end 14 of the mandrel 12 to pass therethrough. The diameter of the opening 50 in the top and bottom plates 46, 48 is approximately the same as the diameter of the mandrel 12 adjacent the top and bottom plates to restrict relative radial movement between the bumper 42 and the mandrel 12. In addition, the bumper 42 is supported on the collar 26 and is restricted from moving axially relative to the mandrel 12 by a washer 52, which in turn is restricted by a garter spring 54 received in a corresponding groove formed in the mandrel 12. The mandrel 12 is thus permitted to rotate relative the bumper 42. The bottom plate 48 preferably comprises a conical recess 55 formed adjacent hole 50 to accommodate the washer 36 and garter spring 38 which secure collar 26 to the mandrel 12.

The outer diameter of bumper 42 is preferably selected to be only slightly smaller than the diameter "$D_1$" of the BOP bore 40 so that bumper 42 may assist in maintaining the mandrel 12 in alignment within the bore 40 and prevent the BPV 20 from impacting with the riser or the BOP bore 40 as the BPV 20 is being run into the wellhead. However, in order for the centralizer 10 to maintain the mandrel 12 properly aligned within the BOP 40, it is only necessary for either the collar 26 or the bumper 42 to have an outer diameter which corresponds to the diameter of the BOP bore 40. In any event, the outer diameter of the bumper 42, or at least the top plate 46, is preferably larger than the diameter "$D_2$" defined by the closed pipe rams of a dual BOP so that the bumper, and not the mandrel 12 or the tool 20, will impact the rams in the event of a blow out or pressure surge.

As illustrated in FIG. 1, the preferred embodiment of the invention contemplates that the collar 26 and the bumper 42 are separate components of the centralizer 10. In this manner, the bumper 42 may be removed and replaced if it has been damaged in an impact with the BOP rams. However, the present invention also contemplates that the collar 26 and the bumper 42 may be constructed as a single component. For example, the collar could form the bottom plate 48 of the bumper 42, in which event a separate collar would not be necessary. Other possibilities for the combination of the collar 26 and the bumper 42 are also considered to be within the scope of the present invention.

Figure 2:
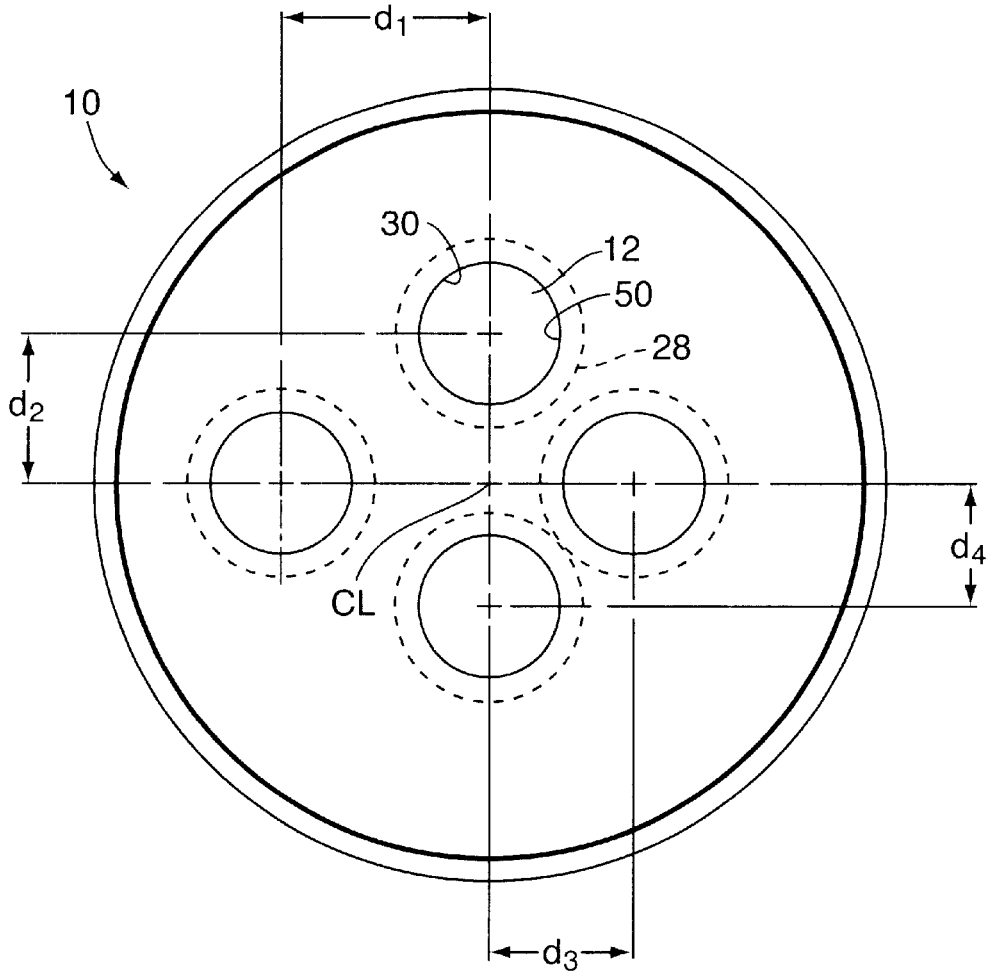
FIG. 2 is a top plan view of an alternative embodiment of the centralizer of the present invention.

Referring now to FIG. 2, a variation of the centralizer 10 is shown in which the collar 26 comprises a plurality of eccentric holes 30 through which the mandrel 12 may extend. The bumper 42 comprises a corresponding number of openings 50 in alignment with the holes 30 to permit the top end 14 of the mandrel 12 to pass therethrough. Each hole 30 is preferably offset from the centerline "CL" of the collar 26 a different distance "d", and each of these distances corresponds to the radial distance between the centerline of the BOP bore and a radially eccentric position within the wellhead bore, such as the position of a specific wellhead component. In this manner, the same centralizer 10 may be used to run various well servicing tools to different wellhead components.

Figure 3:
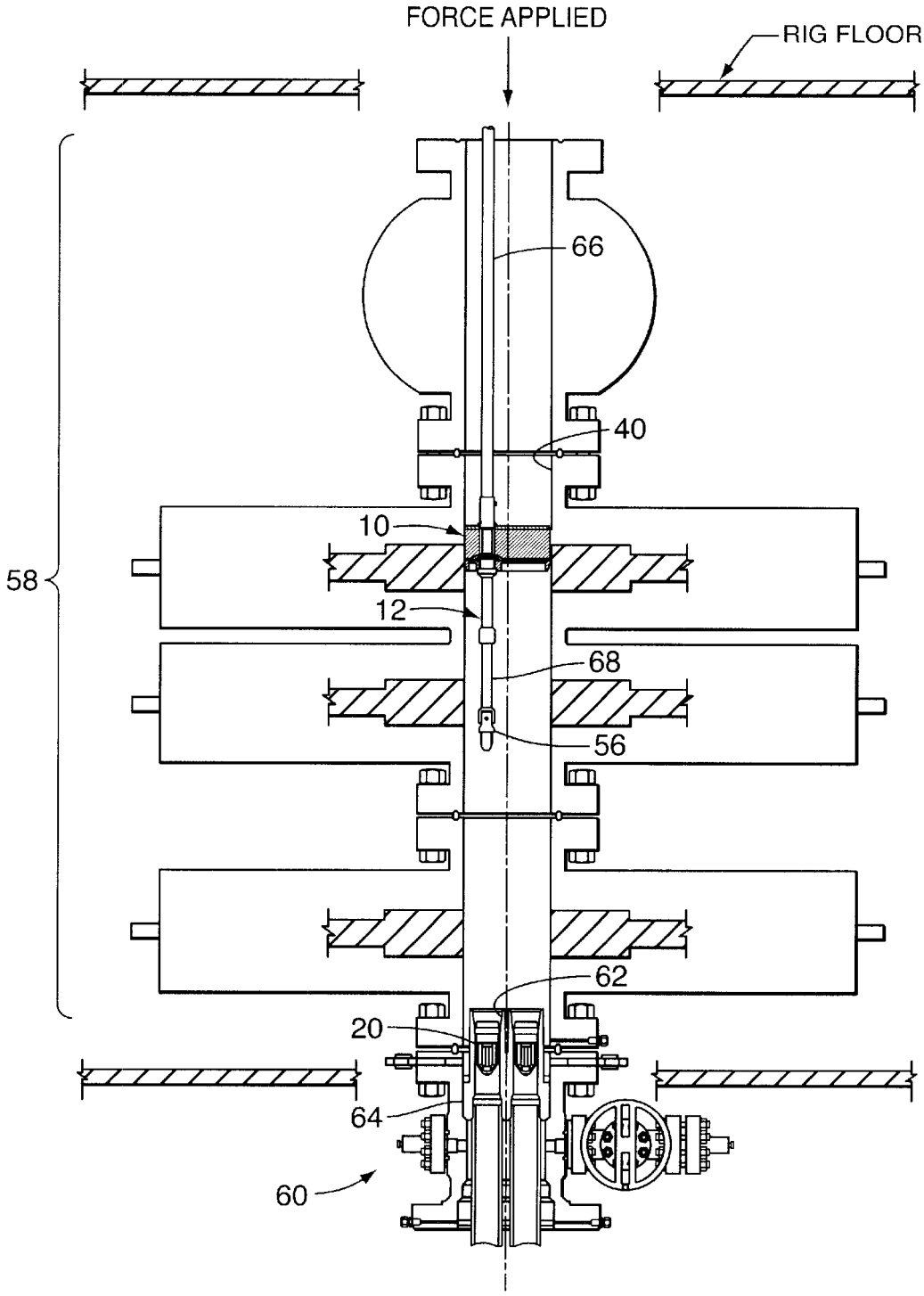
FIGS. 3 through 5 are a sequence of front plan views of the centralizer of FIG. 1 being used to run a retrieval tool through a BOP stack.
Figure 4:
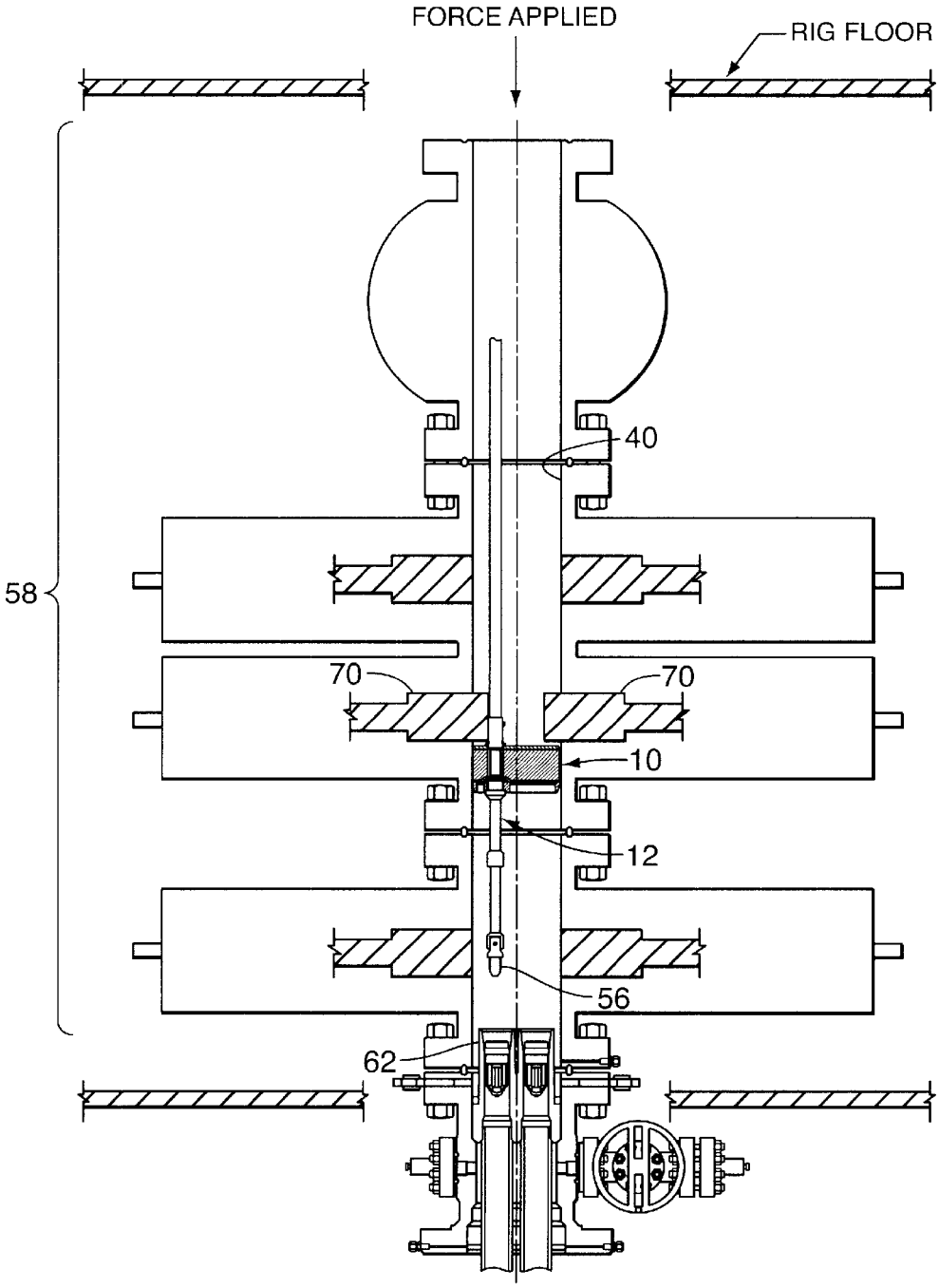
Figure 5:
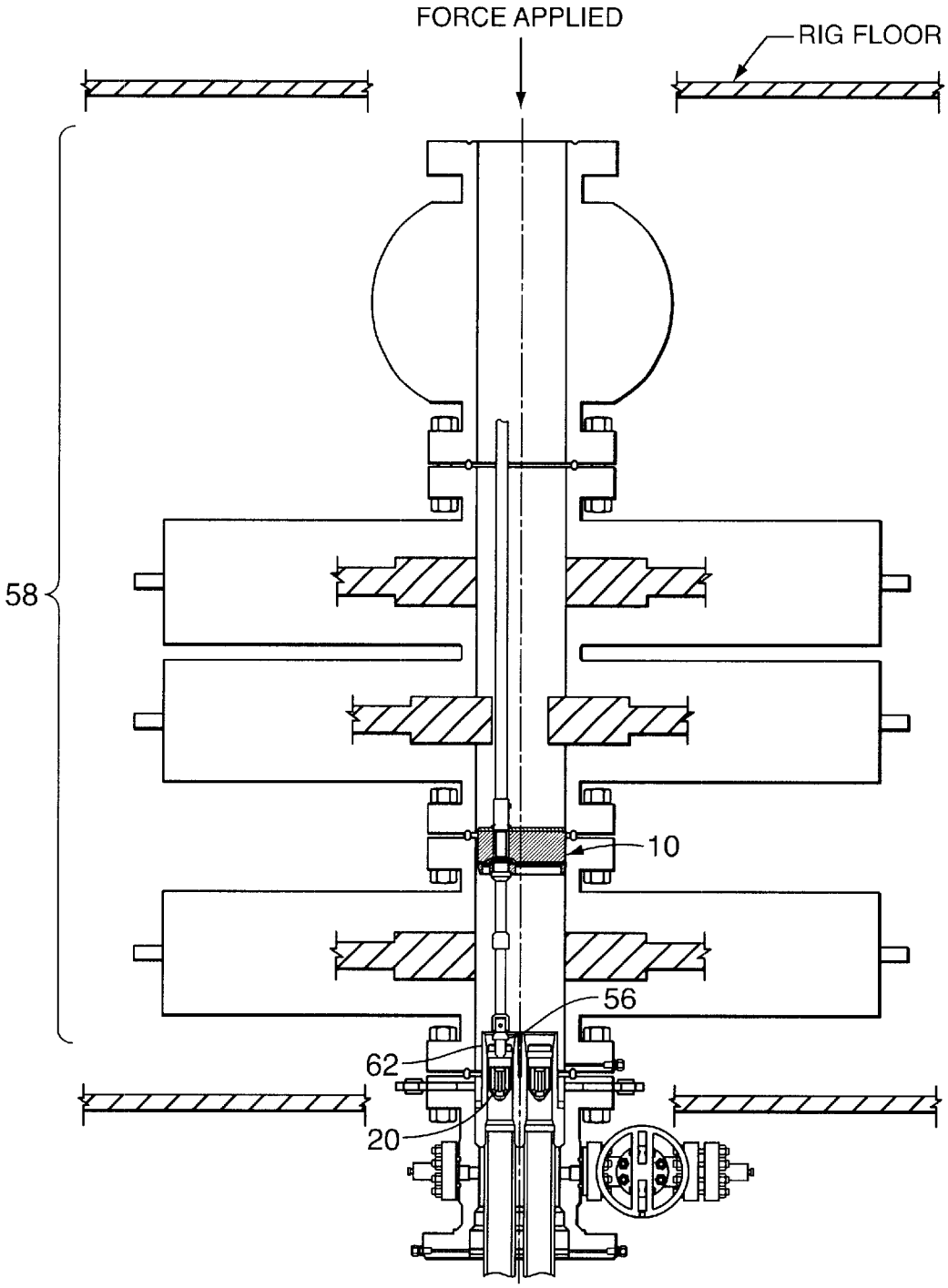

The operation of the centralizer 10 is illustrated in FIGS. 3 through 5. In FIG. 3, the centralizer 10 is shown being used to run a BPV retrieval tool 56 down through a BOP stack 58 and into a wellhead assembly 60 to retrieve a BPV 20 from a receptacle 62 of a dual tubing hanger 64 suspended within the wellhead assembly. The top end 14 of the mandrel 12 is connected to a running string 66, and in this example an extension member 68 is connected between the mandrel 12 and the BPV retrieval tool 56. The extension member 68 is used in certain applications where the mandrel 12 may be too short to properly install the well servicing tool within the wellhead component. The extension member 68 is attached to the bottom end 16 of the mandrel 12 by any suitable means, such as threads, bolts, or a pin. As can readily be seen from FIG. 3, the centralizer 10 maintains the BPV retrieval tool 56 accurately aligned with the eccentrically located receptacle 64 and prevents the tool 56 from impacting the BOP bore 40, which may result in damage to the tool.

In FIG. 4, the centralizer 10 is shown having descended further into the BOP stack, and the rams 70 of one of the BOP's are shown partially closed. In this condition, the BOP is susceptible to being damaged if the centralizer 10 is propelled back into the rams 70 by a well blow out or pressure surge. However, the possibility of such damage is minimized or eliminated by the bumper 42, which will merely collapse to absorb the energy of the impact in such an occurrence.

In FIG. 5, the centralizer 10 is shown having descended to its lowest point in this illustrative example, where the BPV retrieval tool 56 is engaged with the BPV 20 located in the receptacle 62 of the dual tubing hanger 64. The BPV retrieval tool 56 may be attached to the BPV 20 by either linear or rotary actuation, the latter being permitted by the rotational connection between the collar 26 and the mandrel 12. After the BPV retrieval tool 56 is attached to the BPV 20, the running string is merely lifted to retrieve the centralizer 10 and the BPV 20.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

We claim:

1. A centralizer for guiding a tool or the like through the bore of a first member having a central axis and into a radially eccentric position within a second member positioned below the first member, the centralizer comprising:

a mandrel having a top end which is connected to a running string and a bottom end to which the tool is connected;

a collar having an axial centerline and at least one eccentric hole through which the mandrel extends;

means for rotatably connecting the collar to the mandrel;

means for maintaining the axial centerline of the collar proximate the central axis of the first member as the tool is lowered through the bore;

wherein the distance from the axial centerline to the center of the eccentric hole is selected to be approximately equal to the radial distance between the central axis and the radially eccentric position;

whereby the centralizer maintain s the tool in alignment with the radially eccentric position as the tool is being lowered through the bore.

2. The centralizer of claim 1, wherein the collar comprises an outer diameter slightly smaller than the diameter of the bore and the maintaining means comprises the collar.

3. The centralizer of claim 2, further comprising:

means supported on the mandrel above the collar for absorbing an impact between the centralizer and the first member from a direction below the first member.

4. The centralizer of claim 3, wherein the impact absorbing means comprises a bumper having a bottom plate which is supported on the collar, a top plate positioned above the bottom plate, and an energy absorbing core positioned between the top plate and the bottom plate.

5. The centralizer of claim 1, further comprising:

means supported on the mandrel above the collar for absorbing an impact between the centralizer and the first member from a direction below the first member.

6. The centralizer of claim 5, wherein the impact absorbing means comprises a bumper having a bottom plate which is supported on the collar, a top plate positioned above the bottom plate, and an energy absorbing core positioned between the top plate and the bottom plate.

7. The centralizer of claim 6, wherein the bumper comprises an outer diameter slightly smaller than the diameter of the bore and the maintaining means comprises the bumper.

8. A centralizer for guiding a tool or the like through the bore of a first member having a central axis and into a radially eccentric position within a second member positioned below the first member, the centralizer comprising:

a mandrel having a top end which is connected to a running string and a bottom end to which the tool is connected;

means for absorbing an impact between the centralizer and the first member from a direction below the first member, the impact absorbing means comprising an axial centerline and at least one eccentric annular opening through which the mandrel extends;

means for rotatably connecting the impact absorbing means to the mandrel;

means for maintaining the axial centerline of the impact absorbing means proximate the central axis of the first member as the tool is lowered through the bore;

wherein the distance from the axial centerline to the center of the annular opening is selected to be approximately equal to the radial distance between central axis and the radially eccentric position;

whereby the centralizer maintains the tool in alignment with the radially eccentric position as the tool is being lowered through the bore.

9. The centralizer of claim 8, wherein the impact absorbing means comprises first plate, a second plate and an energy absorbing core positioned between the first and second plates.

10. The centralizer of claim 9, wherein the first plate comprises an outer diameter slightly smaller than the diameter of the bore and the maintaining means comprises the first plate.

11. The centralizer of claim 10, wherein the second plate comprises an outer diameter slightly smaller than the diameter of the bore and the maintaining means comprises the first and second plates.

12. The centralizer of claim 9, wherein the first plate comprises a collar having a hole in alignment with the annular opening, the first plate being positioned below the core and the second plate.

13. The centralizer of claim 12, wherein the collar comprises an outer diameter slightly smaller than the diameter of the bore and the maintaining means comprises the collar.

14. The centralizer of claim 8, further comprising:

a collar having a first hole in alignment with the annular opening; and means for rotatably connecting the collar to the mandrel below the impact absorbing means.

15. The centralizer of claim 14, wherein the impact absorbing means comprises a plurality of eccentric annular openings through which the mandrel may extend and the collar comprises a corresponding number of holes in alignment with the annular openings;

whereby the centralizer may be used to maintain the tool in alignment with one of a plurality of radially eccentric positions depending on the hole through which the mandrel extends.

* * * * *